United States Patent [19]

Boen et al.

[11] Patent Number: 4,660,212

[45] Date of Patent: Apr. 21, 1987

[54] COLD CAGE FOR A MELTING CRUCIBLE BY HIGH FREQUENCY ELECTROMAGNETIC INDUCTION

[75] Inventors: Roger Boen, Pont Saint Esprit; Antoine Jouan, Bagnols sur Ceze; Daniel Delage, Gieres; Jean Reboux, Savigny/Orge, all of France

[73] Assignee: Commissariat a l'Energie Atomique, Paris, France

[21] Appl. No.: 747,718

[22] Filed: Jun. 24, 1985

[30] Foreign Application Priority Data

Jun. 29, 1984 [FR] France ..... 84 10364

[51] Int. Cl.[4] ..... H05B 5/00

[52] U.S. Cl. ..... 373/156; 373/157; 219/10.79

[58] Field of Search ..... 373/138, 139, 151–158; 219/10.57, 10.79

[56] References Cited

U.S. PATENT DOCUMENTS 4,207,451 6/1980 Tudbury ..... 219/10.79

FOREIGN PATENT DOCUMENTS 2921472 11/1980 Fed. Rep. of Germany .
1492063 8/1967 France .
1576364 8/1969 France .
2230046 12/1974 France .
2497050 6/1982 France .
1208146 10/1970 United Kingdom .
985684 12/1982 U.S.S.R. ..... 373/156

*Primary Examiner*—Roy N. Envall, Jr.
*Attorney, Agent, or Firm*—Kerkam, Stowell, Kondracki & Clarke

[57] ABSTRACT

Cold cage for a crucible with melting by high frequency electromagnetic induction comprising in per se known manner a series of hollow segments traversed by the cooling water and surrounded by a high or medium frequency induction coil and in which the products to be melted are confined, wherein at least part of the walls of each cage segment is constituted by at least two layers of adjacent materials, whereof the one which resists corrosion is in contact with the products to be melted and whereof the other is a good electricity conductor and wherein the relative thicknesses of these layers as well as the supply frequency of the induction coil are chosen in such a way that the eddy currents induced in the cage mainly develop in a good electricity conducting layer.

4 Claims, 6 Drawing Figures

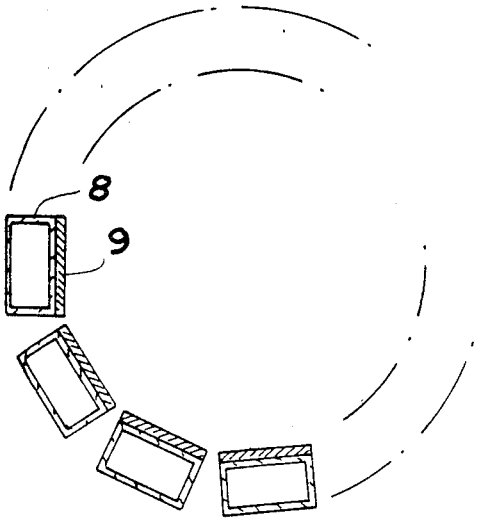
FIG. 3
FIG. 4
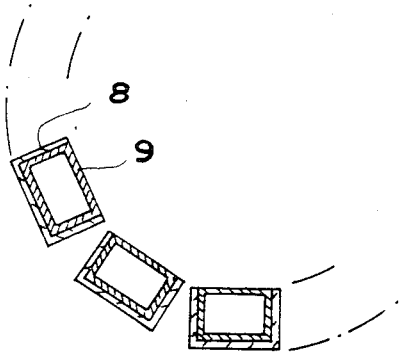
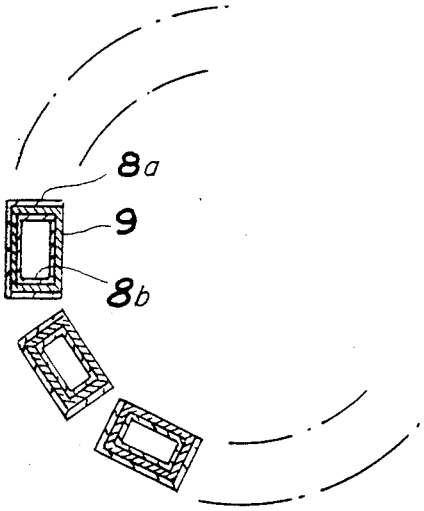
FIG. 5

COLD CAGE FOR A MELTING CRUCIBLE BY HIGH FREQUENCY ELECTROMAGNETIC INDUCTION

BACKGROUND OF THE INVENTION

Over the last few years the technical literature has widely reported so-called cold cages or cold crucibles used in physicochemical applications or special metallurgy, particularly for the melting by high or medium frequency induction of metals or special alloys, or refractory or non-refractory insulating materials, often taking place at elevated temperatures. Most of the cold crucibles described have a number of either straight or hairpin-like segments. Generally the segments are made from copper, which is completely suitable if the melting operation is carried out without direct contact with the crucible under a protective ambient, or if the copper of the crucible is protected from the liquid bath by a protective coating of solid slag or a natural shell of liquid material (insulating under normal conditions) melted by induction at an appropriate frequency and whereof a thin film is solidified on contact with the cold crucible.

This state of the art is represented in FIG. 1, which shows in a perspective elevation a cold crucible, whose cold cage 1 comprises a certain number of copper segments such as 2. This cage 1 is cooled by a circulation of water, diagrammatically represented by inlets 3 and outlets 4 linking the interior of each segment 2 with the exterior. FIG. 1 also shows the induction coil 5, which is responsible for melting the material 6 by high frequency magnetic induction. This material enclosed in the crucible 1 is made internally tight by a solidified crust 7, thus forms to a certain extent the secondary of a transformer, whose inductor 5 is the primary. Under the influence of high frequency secondary currents which occur in material 6, the latter is heated and the sought melting takes place.

However, in a certain number of operations, which is constantly increasing as a result of the great increase in the potential applications of resulting or metallurgical processes in cold crucibles, it may occur when the crucible is immersed in a physically or chemically aggressive environment that the copper is deteriorated either by chemical etching or by the entrainment of copper atoms or particles as a result of surface desorption or erosion. These effects are very prejudicial to the extent that they are liable to bring about premature wear of the crucible or can lead to a pollution of the material treated in the crucible when the latter is used for producing very high purity materials.

These prejudicial phenomena linked with the presence of copper as the base metal of the cold cage are made worse when the latter is used as an enclosure for the confinement or maintaining of an inductive plasma, such applications becoming increasingly numerous. Such inductive plasma torches are ever more widely used for the preparation of metals, alloys or ultra-pure precious materials, such as silica, quartz, alumina, silicon, titanium, etc.

SUMMARY OF THE INVENTION

The present invention specifically relates to a cold cage for a crucible with melting by electromagnetic induction making it possible to obviate the disadvantages of the prior art, whilst retaining the well known advantages of melting or physicochemical treatment in a cold crucible.

This cold cage for a crucible for melting by electric induction comprising in per se known manner a series of hollow segments traversed by the cooling water, surrounded by a high or medium frequency induction coil and in which the products to be melted are confined, is characterized in that at least part of the walls of each segment of the cage is constituted by at least two layers of adjacent materials, whereof one which resists corrosion is in contact with the products to be melted, and whereof the other is a good electricity conductor and in that the relative thicknesses of these layers, together with the supply frequency of the electrical conductor are chosen in such a way that the eddy currents induced in the cage mainly develop in a good electricity conducting layer.

Thus, the structure of the cold cage according to the invention essentially consists of producing the crucible segments not solely of copper, but with a composite structure having at least two metals which are closely applied to one another, one being an electricity conductor, i.e. having minor Joule losses, whereas the other is more electrically resistive and has a greater resistance to corrosion. This composite structure or sandwich is either applied to the complete cage or at least to the inner wall thereof more espeically exposed to the effects of corrosion or physicochemical attacks, or even hydrodynamic effects in the case of plasmas.

The essential arrangement of the structure according to the invention consequently consists of choosing the respective thicknesses of the anti-corrosive metals and the good conducting metal in such a way that the eddy currents induced in the cage are under the influence of the primary induction coil and whereof it is known that the depth at which they are located is dependent on the frequency of the induction, largely develop in a good electricity conducting layer, so as to make the Joule effect losses of the system minimal.

According to the invention, the metal acting as the anti-corrosion agent of the crucible and present on the face of the segment turned towards the inside of the crucible is constituted by a stainless steel well known for its resistance in an aggressive medium. However, it is also known that if the thickness of the stainless steel is equal to or greater than the penetration depth of the currents at the working frequency of said metal, or approximately 5 mm at 10 kHz or 5/10 mm at 1 MHz, the Joule loses developed in the outer stainless steel layer are 6 or 7 times greater than those observed in the wall with identical dimensions and made from copper. This is highly prejudicial to obtaining an acceptable electrical efficiency of the treatment performed in such a crucible and the invention makes it possible to avoid this snag.

Thus, by a suitable choice of the thicknesses of the copper and stainless steel layers and the induction frequencies, the practical arrangements of the cage according to the invention make it possible to provide a cold crucible having both an excellent corrosion resistance and Joule losses which are compatible with an acceptable electrical efficiency.

BRIEF DESCRIPTION OF THE DRAWINGS

The invention is described in greater detail hereinafter relative to several non-limitative embodiments of a cold cage for a crucible with melting by electric induction and with reference to tthe accompanying drawings in which:

FIG. 3 depicts a constructional variant and is a view in a section perpendicular to the crucible axis, part of the segments of the cold cage in the case of a bimetallic structure limited to the inner wall of the crucible;

FIG. 4 is also a view in a section along a plane parallel to the crucible axis depicting a two-layer bimetallic structure configuration; and FIG. 5 depicts another embodiment and is also a view in a section along a plane perpendicular to the crucible axis, part of the segments constituting a cold cage with segment walls of multilayer sandwich construction.

DETAILED DESCRIPTION OF THE PREFERRED EMBODIMENTS

Figure 1:
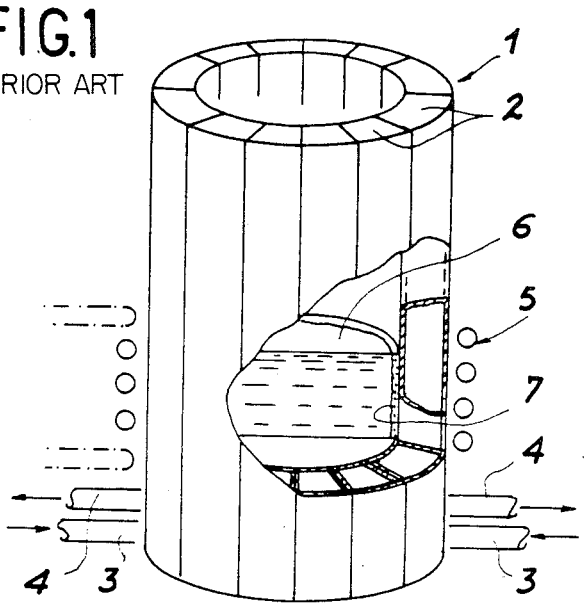
FIG.1 PRIOR ART
FIG. 1, referred to hereinabove, is a perspective elevational view of a prior art cold crucible.
Figure 2A:
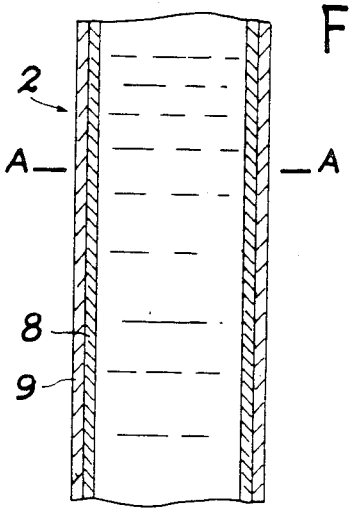
FIG. 2*a* is a view in elevation and FIG. 2*b* is a plan view of a bimetallic rectangular cold cage segment according to the invention.
Figure 2B:
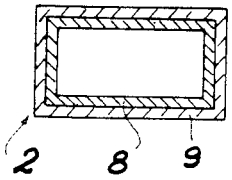

FIGS. 2*a* and 2*b* (sectional view along horizontal plane AA of FIG. 2*a*) show the possible construction according to the invention of a segment 2 of a cold cage for a crucible by melting by electric induction.

In this first embodiment of the invention, the inner wall 8 of the crucible segments is made from copper having an appropriate thickness, generally between 1 and 3 mm. The outer stainless steel wall 9 is e.g. in the form of a regular, uniform stainless steel coating, whose thickness is less than the penetration of the currents into the stainless steel. For example, a 20 to 40 μm coating is applied for a design operating frequency above 1 MHz and a 50 to 100 μm coating is applied for a design operating frequency between 500 kHz and 1 MHz. Calculation and experience show that crucibles produced according to this arrangement have a good resistance to corrosion, whilst having Joule losses only slightly in excess of those of a copper cold crucible. The stainless steel coating 9 is formed by using well known physicochemical processes, such as e.g. sputtering in the case of deposites having a limited thickness e.g. below 200 μm. For much greater thicknesses and particularly between a few B 1/10 to a few mm, it is possible to use schooping.

As a constructional variant, FIG. 3 also shows a bimetallic structure for the cold cage segments in which the good conducting metal coating 8, generally of copper, is only coated on the face turned towards the inside of the crucible with a protective, stainless steel deposit 9. This structure, which is simplified compared with the previous structure, can be used when the inner face of the crucible facing the corrosive charge is the only face exposed to corrosion, particularly due to the good insulation of the other faces of the segments facing the molten material.

In a second embodiment shown in FIG. 4, the cold cage segments are made from stainless steel 9. A copper deposit 8 having a thickness equal to or slightly greater than the penetration depth of eddy currents into the copper at the working frequency is applied to the three faces of the stainless steel section 9 not exposed to the aggressive or corrosive nature of the medium. The thickness of the copper deposit 8 is about 20 microns if designed for an operating frequency between 1 and 5 MHz, about 50 microns if designed for an operating frequency between several hundred kHz and 1 MHz, and a few hundred microns if designed for an operating frequency around 10 kHz. In this embodiment, the Joule losses are only slightly increased compared with those of a copper crucible in proportion to the effective length of the stainless steel present, relative to the total periphery of the segment.

Finally, and still within the scope of the invention, as shown in FIG. 5 it is also possible to combine the two aforementioned crucible constructions as described in FIGS. 3 and 4 in order to provide a three-layer crucible structure. In FIG. 5, the cold cage segments are made from stainless steel 9. A copper deposit 8*a* is applied to the three faces of the stainless steel section 9 not exposed to the aggressive or corrosive nature of the medium. A copper layer 8*b* is provided inside the stainless steel section 9.

The cold crucibles described have numerous applications in widely varying scientific and industrial fields, ranging from "autocrucible" or induction melting of insulants, such as glass, refractory oxides etc. to melting in the presence of slag of conductive alloys or metals, such as titanium, zirconium, stainless steel, etc., as well as the production of inductive plasma torches used in a highly aggressive medium, e.g. halogen or hydrogen medium plasma.

It is obvious that the invention is not limited to the above examples, particularly with respect to the shape of the segments constituting the cold crucible and any profile other than rectangular, e.g. circular, trapezoidal, etc. must be considered as falling within the scope of the invention.

Finally, the invention is also applicable to any form of cold crucible other than a cylindrical shape, such as e.g. to frustum-shaped or cylindroconical cold crucibles, which, particularly in the case of plasma uses, permit selective dynamic effects coinciding with the sought metallurgical or physicochemical objective.

What is claimed is:

1. A cold cage for a crucible for melting products employing high frequency electromagnetic induction, said cold cage comprising:

a series of hollow segments cooled by cooling fluid and surrounded by an induction coil and in which the products being melted are confined;

at least part of the walls of each cage segment being formed of at least two layers of adjacent materials, one of the materials having a greater resistance to corrosion than the other, and the other of the materials having a higher electrical conductivity than the one;

the relative thicknesses of the layers and the supply frequency of the induction coil being chosen such that the eddy currents induced in the cage mainly develop in a layer of the material having a higher conductivity so that Joule losses are low.

2. A cold cage according to claim 1, wherein the material having a greater resistance to corrosion is stainless steel, and the material having a higher electrical conductivity is copper.

3. A cold cage according to claim 1 wherein:

each segment is made from the material having a greater resistance to corrosion, with the faces not in contact with the products being melted being coated with a layer of the material having a higher electrical conductivity; and each segment also having an internal coating of a layer of the material having a higher electrical conductivity.

4. A cold cage according to claim 2 wherein:

each segment is made from the material having a greater resistance to corrosion, with the faces not in contact with the products being melted being coated with a layer of the material having a higher electrical conductivity; and each segment also having an internal coating of a layer of the material having a higher electrical conductivity.

* * * * *